US007238632B2

(12) United States Patent
Orita et al.

(10) Patent No.: US 7,238,632 B2
(45) Date of Patent: Jul. 3, 2007

(54) ELECTROMAGNETIC WAVE SHIELDING MATERIAL

(75) Inventors: Shigekazu Orita, Fukui (JP); Toru Takegawa, Fukui (JP); Yasufumi Katsuki, Fukui (JP); Fumio Shirasaki, Fukui (JP)

(73) Assignee: Seiren Co., Ltd., Fukui-shi, Fukui (JP)

( * ) Notice: Subject to any disclaimer, the term of this patent is extended or adjusted under 35 U.S.C. 154(b) by 204 days.

(21) Appl. No.: 09/896,058

(22) Filed: Jun. 29, 2001

(65) Prior Publication Data

US 2002/0016119 A1 Feb. 7, 2002

(30) Foreign Application Priority Data

Jun. 30, 2000 (JP) ..... 2000-199081

(51) Int. Cl.
*B32B 15/14* (2006.01)
*D04B 1/16* (2006.01)

(52) U.S. Cl. ..... 442/317; 442/304; 442/308; 442/309; 442/310; 442/311; 442/316; 442/181; 442/205; 428/86

(58) Field of Classification Search ..... 442/304, 442/308, 309, 310, 311, 316, 317, 205, 181; 428/86; 139/3–7
See application file for complete search history.

(56) References Cited

U.S. PATENT DOCUMENTS 4,201,825 A * 5/1980 Ebneth ..... 442/231
4,901,738 A * 2/1990 Brink et al. ..... 128/849
5,532,052 A * 7/1996 Eng et al. ..... 442/314
5,589,245 A * 12/1996 Roell ..... 428/85
5,974,784 A * 11/1999 Feldman ..... 60/272
6,569,789 B1 * 5/2003 Shioda et al. ..... 442/221

FOREIGN PATENT DOCUMENTS

DE 0748889 A2 * 12/1996
JP 402082696 * 3/1990
JP WO 98/06247 * 2/1998
JP 02000273762 * 10/2000

* cited by examiner

*Primary Examiner*—Norca L. Torres-Velazquez
(74) *Attorney, Agent, or Firm*—Dilworth & Barrese, LLP

(57) ABSTRACT

The present invention provides an electromagnetic wave shielding material including a three dimensionally knitted base material and a conductive metal layer formed on the three dimensionally knitted base material, which shielding material is characterized in that it comprises: a heat-fusing thread used at at least a portion of the three dimensionally knitted base material; and a portion in which connection thread is not present, wherein the amount of cutting debris generated at the time of cutting is decreased. According to the present invention, an electromagnetic wave shielding material, which is used for an electromagnetic wave shielding gasket for shielding electromagnetic wave, exhibits good workability if the thickness of the product is relatively thin, suppresses the metal separation and reduces the amount of cutting debris generated at the time of cutting, is obtained.

21 Claims, 3 Drawing Sheets

ELECTROMAGNETIC WAVE SHIELDING MATERIAL

FIELD OF THE INVENTION

The present invention relates to an electromagnetic wave shielding material which shields undesirable electromagnetic wave radiated from outside of the environment and also shields electromagnetic wave leaking from inside of the environment.

BACKGROUND OF THE INVENTION

In intelligent buildings and FA factories, electronic appliances and communication devices such as personal computers, office-automation devices, factory-automation devices etc. have been generally introduced. As a result, erroneous operations of electronic devices, as well as electronic wave disturbance such as communication disturbance, which occur inside these buildings and factories due to the electromagnetic wave radiated from the electronic appliances and the communication devices as described above or undesirable electromagnetic wave coming from the outside of the environment, have now become a significant social problem.

In order to prevent such leakage of undesirable electromagnetic wave from the environment, as well as erroneous operations of electronic devices and electronic wave disturbance such as communication disturbance due to invasion of extrinsic electromagnetic wave, it has been considered that an information network using optical fibers, coaxial cables or the like is established inside an intelligent building or a FA factory so that information can be transmitted/received rapidly and accurately. However, there is a problem, in this method, that construction of such a network costs a lot of money. Therefore, there has been proposed another method in which the whole building is shielded from the outside environment and information exchange inside the building is carried out by wireless communication. In order to effect this method, it has conventionally been attempted that metal plates or metal foils of iron, copper, aluminum or the like as electromagnetic wave shielding materials are laminated to building materials such as board materials or a wall material which shields electromagnetic wave is employed.

Further, at opening/closing portions such as doors and windows, a gasket for shielding electromagnetic wave is generally provided, so that the undesirable electromagnetic wave radiated from outside of the environment, as well as the electromagnetic wave which leaks from inside of the environment, can be shielded.

Examples of such a gasket include a gasket produced by the steps of: slicing an elastic foam block such as polyurethane sponge by a predetermined thickness by a slicer; cutting each slice to pieces having a predetermined width, thereby to obtain short, strap-like structures each having a rectangular section; optionally connecting one structure with another at the ends thereof, thereby to obtain a long, strap-like structure; and laminating a conductive sheet around each strap-like structure by way of an adhesive agent layer, the conductive sheet being composed of an aluminum foil laminate film or a conductive woven cloth around which a film layer of copper, nickel or the like has been formed, and a gasket for shielding electromagnetic wave which is produced by providing a metal film on the strap-like structure itself.

OBJECTS OF THE INVENTION

However, in the aforementioned methods in which the elastic foam strap-like structure (such as a sponge) is employed, there arises a problem that slicing is difficult to perform when extremely thin slices (e.g., no thicker than 2 mm) are to be obtained, because slices are produced by slicing the sponge-like, elastic foam block by a predetermined thickness by a slicer, as described above. In order to overcome this problem, there has been made an attempt that the elastic foam block is sliced thicker than the predetermined thickness and the obtained slices are made to have a predetermined thickness by compressing the slices under an increased pressure and providing the slices with permanent strain. As a result, in the case of the conventional method in which the strap-like structures are made by slicing, there may arise problems that thin slices are difficult to be obtained and the accuracy of dimension in the thickness direction is poor. In addition, this conventional method ends up with a high production cost because it requires a number of production steps, such as compressing the slices under an increased pressure.

A gasket can be produced by what is called "the continuous foaming method" which includes the steps of: inserting a conductive woven cloth into a mold so that a hollow portion is created therein; and filling the hollow portion with a foaming raw material, with allowing the foaming raw material to foam, thereby producing a gasket. However, when a gasket is produced in such a manner, setting of the processing conditions (including selection of the raw material for effecting foaming, the charging and foaming method, the temperature condition) is difficult and thus high-standard control technique is required, resulting in a high facility cost, although the production efficiency thereof is relatively high. Further, in the gasket of such a type, the dimension accuracy may be relatively poor because foaming tends to proceed to some extent even after the foamed product is pulled out of the mold.

In recent years, as the electric appliances are becoming thinner, a gasket material having thickness of 100–1000 μm or so is now increasingly in demand. This trend has made the aforementioned problem even more obvious.

The thickness of a conductive woven cloth produced by providing a woven cloth with conductivity is generally 60–200 μm or so, and the thickness of a conductive unwoven cloth produced by providing a unwoven cloth with conductivity is generally 60–500 μm or so. Such a conductive woven/unwoven cloth, which is made of only the conductive material, may be used as a thin gaslekt material. However, as the conductive woven/unwoven cloth made of only the conductive material exhibits poor cushioning property, the conductive woven/unwoven cloth of such a type is not suitable as a gasket material.

Further, the conductive material produced by forming a metal layer on the surface of a porous skeleton such as a strap-shaped, urethane sponge-like elastic foam structure (the polyurethane porous structure, in particular) has defects such as poor deterioration resistance property, although the conductive material of such a type shows relatively excellent electromagnetic wave shielding property. Yet further, the conductive material of this type hardly obtains sufficient flame resistance, and if a relatively large amount of flame retardant agent is provided thereto, the deterioration may proceed worse.

In JP-A 2001-3264, there is disclosed a knitted-woven fabric having a three dimensional structure with continuous holes, in which structure metal is attached to at least a portion of the structure thread and at least a portion of the structure thread is a conductive fiber. The publication states that the structure as described above allows a more degree of freedom in designing, enables obtaining three-dimensional structures of various sizes, and eliminates the complicated processing steps.

However, it should be noted that a gasket is generally cut into a predetermined length at the time of using the gasket, prior to being used. In the case of the gaskets of the aforementioned types, cutting debris tends to be generated, at the time of cutting, from the cut portion thereof. In particular, the gasket in which a metal has been attached or coated, by the known method such as plating, to a base material composed of urethane sponge or three dimensionally knitted structure is likely to generate conductive cutting debris. If such cutting debris drops to the inside of the electronic device, a significant influence including short circuit may be caused.

SUMMARY OF THE INVENTION

In the first aspect of the present invention, an electromagnetic wave shielding material comprises a fibrous structure base material and a conductive metal layer, wherein the fibrous structure base material is a three dimensionally knitted base material composed of an upper ground structure, a lower ground structure and connection thread.

In the second aspect of the present invention, the aforementioned electromagnetic wave shielding material is characterized in that a heat-fusing thread is used at at least a portion of the three dimensionally knitted base material.

In the third aspect of the present invention, the aforementioned electromagnetic wave shielding material is characterized in that the heat-fusing thread is used by the amount of 30 to 90 mass % of the thread as one constituent of the three dimensionally knitted base material.

In the fourth aspect of the present invention, the aforementioned electromagnetic wave shielding material is characterized in that the heat-fusing thread is a composite thread having a core-sheath structure in which the core of the thread is made of polyester of one type and the sheath portion of the thread is made of polyester of another type whose melting point is lower that of the polyester of the one type, and the weight ratio of the core with respect to the sheath is in the range of 1:2 to 9:1.

In the fifth aspect of the present invention, the aforementioned electromagnetic wave shielding material is characterized in that the connection thread of the three dimensionally knitted base material is provided so that, at a sectional portion of the three dimensionally knitted base material, the direction in which the connection thread is arranged avoids intersecting the sectional plane.

In the sixth aspect of the present invention, the aforementioned electromagnetic wave shielding material is characterized in that the three dimensionally knitted base material has a double raschel structure.

In the seventh aspect of the present invention, the aforementioned electromagnetic wave shielding material is characterized in that a conductive metal layer of the electromagnetic wave shielding material is coated with a synthetic resin.

BRIEF DESCRIPTION OF THE DRAWINGS

In FIGS. 3–5, A denotes the number of battens and B denotes structure.

DETAILED DESCRIPTION OF THE INVENTION

Figure 1:
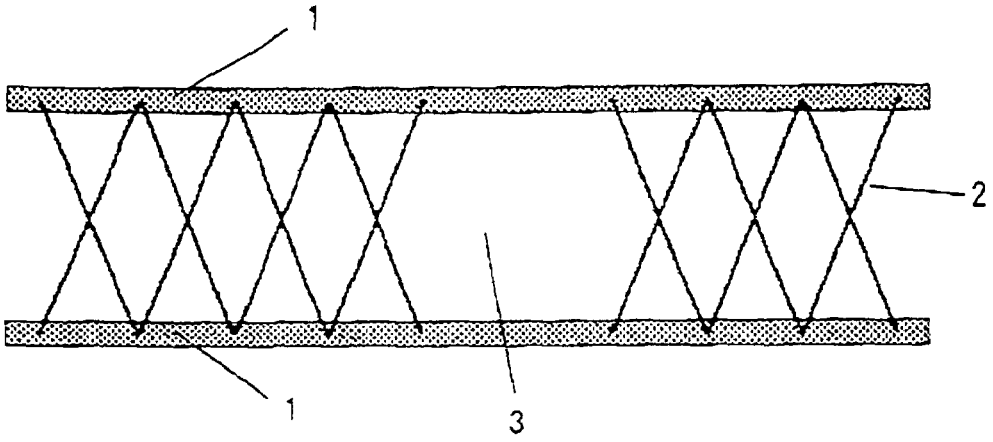
FIG. 1 is a schematic sectional view of one example of a three dimensionally knitted base material of the present invention.

In the present invention, the type of the base material is not particularly restricted as long as the base material can have a three dimensional structure. However, it is preferable to employ a three dimensionally (woven-)knitted base material, which includes, as main constituent members, an upper ground structure, a lower ground structure and a connection thread for connecting the upper ground structure and the lower ground structure and is produced by knitting by a double row needle bed type weaving-knitting machine. Among the three dimensionally knitted base material, that having the double raschel knitting structure is particularly preferable. The base material having such a structure exhibits excellent recovering property from compression, as well as excellent deterioration resistance property, and thus can be preferably used as an electromagnetic wave shielding material for a gasket or the like.

Examples of the fiber material which constitutes the fibrous structure knitted base material include the conventionally known base materials such as synthetic fiber and natural fiber. Among these examples, polyester fiber such as polyethyleneterephthalate, which has excellent resilience recovering property and deterioration resistance property, is preferable.

Further, it is preferable that a heat-fusing thread is used as the fiber material which constitutes the fibrous structure knitted base material. The type of the heat-fusing thread to be used is not particularly restricted, and examples thereof include a heat-fusing thread which is as a whole constituted of a low-melting point thread, a heat-fusing thread which is produced by side-by-side type composite spinning of a high-melting point thread and a low-melting point thread and the like. Among these examples, it is preferable to use a polyester-based heat-fusing thread of the core-sheath composite type in which a high-melting point polyester (what is called "regular polyester") is used for the core portion and a low-melting point polyester is used for the sheath portion. It is preferable that the melting point of the low-melting point thread is in the range of 100 to 190° C. When the melting point of the low-melting point thread is lower than 100° C., the thread may melt during the use thereof as a shield material. On the other hand, when the melting point of the low-melting point thread is higher than 190° C., the thread may not be fused in an appropriate manner.

It is preferable that the weight ratio of the core with respect to the sheath is in the range of 1:2 to 9:1. When the ratio of the core with respect to the sheath is smaller than the aforementioned lower limit (1:2), there may arise a problem in the strength of the thread. On the other hand, when the ratio of the sheath with respect to the core is smaller than the aforementioned lower limit (9:1), the sufficient adhesion effect of the thread may not be obtained.

The heat-fusing thread may be used at any of the upper ground structure, the lower ground structure and the connection thread of the three dimensionally knitted base material. Use of the heat-fusing thread at the portions which constitute the upper ground structure and the lower ground structure is particularly preferable, because the low-melting point thread is fused at the time of processing and is attached with each other, whereby the amount of cutting debris generated at the time of cutting can be reduced.

The fiber material may be produced by knitting a high-melting point thread (regular thread) and a heat-fusing thread in an alternate or mixed manner.

Examples of the connection thread used in the three dimensionally knitted base material of the present invention include: the connection thread having a normally intersecting connection thread which connects the upper ground structure with the lower ground structure in a manner that the connection thread (substantially) normally intersects the upper ground structure and the lower ground structure; the connection thread having a diagonally intersecting connection thread which connects the upper ground structure with the lower ground structure in a manner that the connection thread diagonally intersects the upper ground structure and the lower ground structure; the connection thread having a truss structure which includes both the normally intersecting connection thread and the diagonally intersecting connection thread in a combined manner. In terms of effectively achieving the resilient elasticity of the base material and reducing the compressive residual strain, the connection thread having the diagonally intersecting connection thread is preferable.

Further, in order to obtain sufficient resilient elasticity, reduce the compression residual strain and decrease the amount of cutting debris generated at the time of cutting the electromagnetic wave shielding material, it is preferable that the monofilament-based connection thread is used.

Yet further, it is preferable that the three dimensionally knitted base material is structured such that the base material has portions at which the direction of cutting (i.e., the cutting blade) can avoid intersecting the connection thread. When the three dimensionally knitted base material has such a structure, by cutting the three dimensionally knitted base material at these portions, the generation of debris at the time of cutting can be further suppressed.

Figure 2:
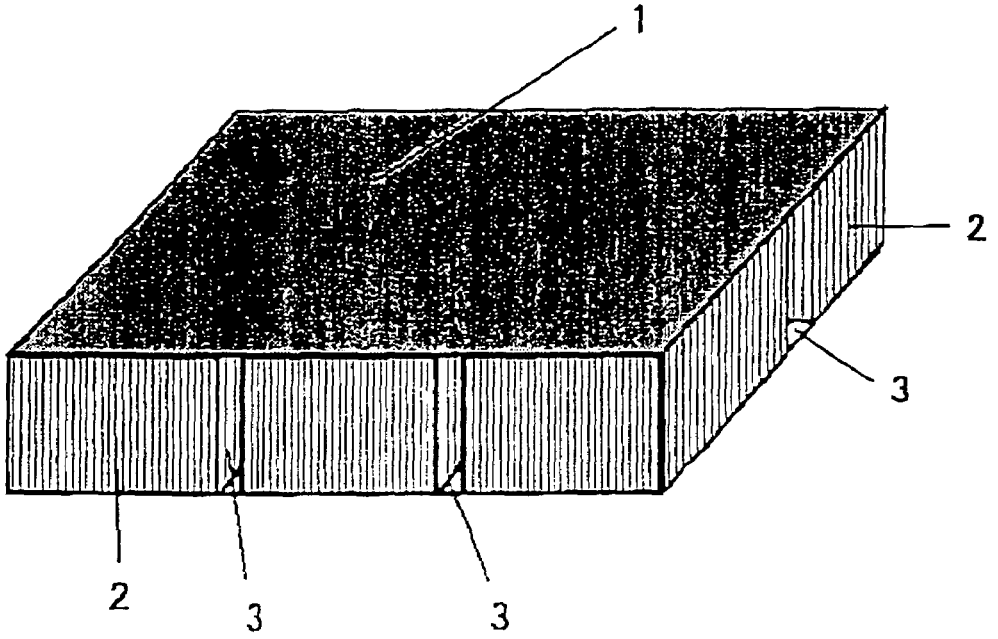
FIG. 2 is a schematic perspective view of one example of a three dimensionally knitted base material of the present invention.

FIG. 2 is a schematically illustrated perspective view which shows one example of the arrangement of the connection thread in the three dimensionally knitted base material of the present invention. The upper ground structure is connected with the lower ground structure by arranging, on the knitting device, the portions having the connection thread and the portions not having the connection thread, with a predetermined distance therebetween, in the well direction and/or the course direction of the knitted base material, as shown in FIG. 2. By cutting the three dimensionally knitted base material at the portions not having the connection thread at the time of cutting, the amount of cutting debris generated at the time of cutting can be suppressed.

The portion not having the connection thread may be located in both the well direction and the course direction, or may be located only in one of these directions of the three dimensionally knitted base material. In short, the portion not having the connection thread may be provided in any suitable manner, according to the condition in which the three dimensionally knitted base material is actually used.

Figure 3:
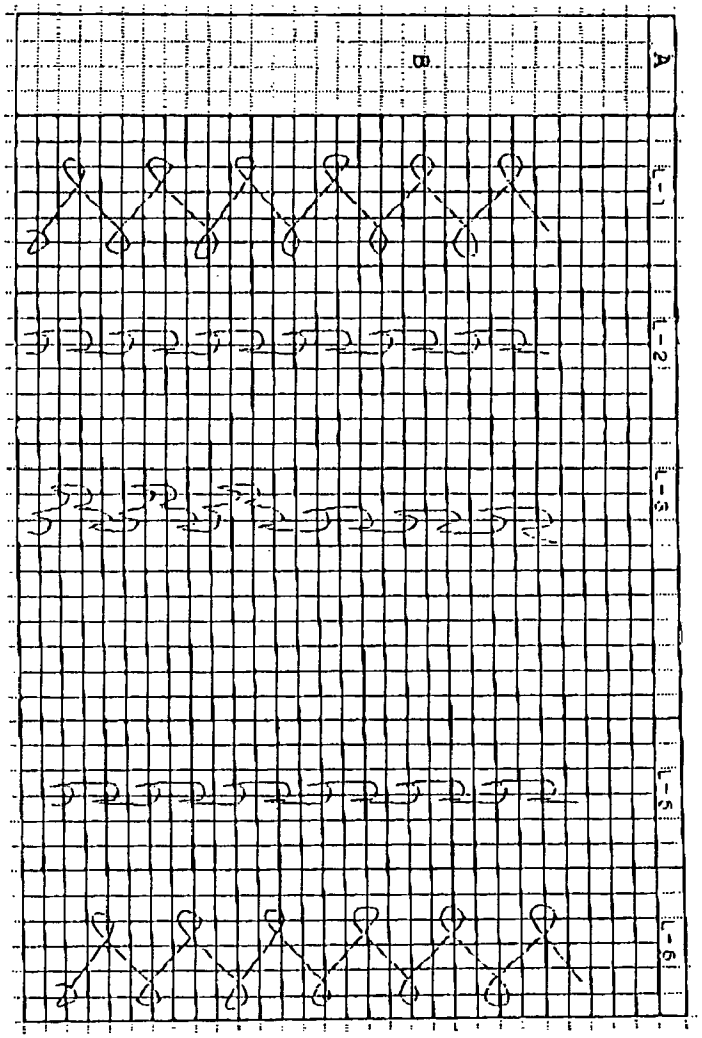
FIG. 3 is a structural view of one example of a three dimensionally knitted base material, which includes a portion in which connection thread is not present, of the present invention.

Further, at the time of connecting the connection thread to the upper ground structure and the lower ground structure by arranging the connection thread in the ground structures in the well direction and/or the course direction with a predetermined distance therebetween, as shown in FIG. 2, by knitting the connection thread into the same ground structure again (without knitting the connection thread into the opposite ground structure) at a predetermined interval, the portions having the connection thread and the portions not having the connection thread can be alternately produced. The interval between the portions having the connection thread and the portions not having the connection thread can be set at any suitable distance. In addition, the thickness of the three dimensionally knitted structure, the density of the thread, and the type of the thread which to be used can be changed according to the conditions in which the three dimensionally knitted base material is actually used. Accordingly, the three dimensionally knitted structure of the present invention can be flexibly modified to different sizes. The structure shown in FIG. 3 is simply one example, and needless to say, the present invention is not restricted to this particular example.

The ground structures are preferably constructed so as to be hardly extended. If the ground structures have good extensibility, the space between the thread clusters tends to widen due to deformation of the ground structures, whereby the electromagnetic wave shielding property may deteriorate and/or the metal layer may more easily peel off. Therefore, the three dimensionally knitted base material having the structure in which no opening portion is provided at either the upper ground structure or the lower ground structure is preferably employed. Examples of the preferable structure of such a type include the combination of a chain structure and a code structure, and the like.

In addition, it is preferable that the density of the thread which constitutes the ground structure is relatively high.

As a result of the structures described above, the electromagnetic wave shielding material of the present invention exhibits excellent electromagnetic wave shielding property.

The metal layer formed on the base material may be provided by using the known methods such as spattering, vacuum deposition and plating. In order to evenly form the metal layer and achieve excellent conductivity and shielding property, it is preferable that the metal layer is formed by electroless plating. Electrolytic plating may optionally be carried out after carrying out the electroless plating.

Examples of the metal to be used for forming the metal layer include known metals such as silver, copper, and nickel.

In order to reduce the amount of cutting debris generated at the time of cutting and suppress separation of the metal layer from the base material, it is preferable that the metalized base material is coated with a resin, after the metal layer is provided on the base material, but prior to cutting. The type of the resin to be coated is not particularly restricted, and may be a thermoplastic resin or the like. In terms of achieving excellent workability and flexibility, an acrylic resin is preferable. The resin can be provided on the metalized base material by using the conventionally known methods such as padding and coating.

By adding various types of flame retardant, the fire retardancy of the product can be improved. Examples of the flame retardant include: the halogen-based flame retardant represented by bromine-based and chlorine-based flame retardant; the antimony-based flame retardant such as antimony trioxide; and the phosphorus-based flame retardant. These examples of the flame retardant may be used solely or in a combined manner. The combination of the bromine-based flame retardant and the antimony-based flame retardant, in particular, exhibits an excellent effect in use. Examples of the method of providing the flame retardant include padding, knife coating, and gravure coating of the mixture of the flame retardant and a solvent-based or water-based synthetic resin. As the fire retardancy of the product is improved as a result of adding the flame retardant, the product can be used in the fields where excellent fire retardancy is required, such as electric appliances for domestic use.

As described above, the electromagnetic wave shielding material of the present invention employs the three dimensionally knitted base material such as the double raschel knitting structure. Accordingly, by setting the types of the thread to be used, the denier of the thread, the number of filament count, the knitting structure and/or the knitting density in an appropriate manner, the properties of the electromagnetic wave shielding material (such as flexibility) can be controlled. Further, the base material of the double raschel knitting structure can be shaped so as to have any desired shape. For example, the base material of such a type can be shaped so as to have a toroidal shape by removing the center portion thereof by using die-cutting. By designing a three dimensionally knitted structure having the required thickness, the electromagnetic wave shielding property of the product is further improved.

Yet further, the electromagnetic wave shielding material of the present invention can be used, not only for a gasket, but also for a taping material (a grounding material).

EXAMPLES

The present invention will be specifically demonstrated by the following examples. The method of measurement used in the examples are as follows.

1. Thickness

Measurement was made according to JIS L-1098

The measuring device: At-constant-pressure thickness measuring device TYPE PF-11 (manufactured by Rafurokku Co.)

2. Pressure Observed When the Sample was Compressed by 50%

A sample which had been cut into 10 mm×10 mm size was placed on a pressure receiving plate and compressed at the compression rate of 0.5 mm/sec. The load was recorded when the thickness of the sample shrank to 50% of the original thickness. The measured load was divided by the area of the sample, whereby the pressure at the time of 50% compression was obtained.

3. Shielding Property

The shielding property was measured according to the KEC method, by using a sample of 120 mm×120 mm size. Specifically, the sample was placed between the antenna for transmission and the antenna for reception in a shielded box, and the strength of the received electromagnetic wave was measured. The damping rate (dB) was obtained from the ratio of the strength value of the received electromagnetic wave with respect to the strength value of the received electromagnetic wave when the sample was not present.

4. Metal Separation

A sample of 50 mm×50 mm size was placed on a white cloth. A roller of 500 g weight was placed on the sample. The roller was reciprocally operated on the sample 250 times, and then the condition of metal layer separation (peeling off) was visually evaluated.

○: Separation of metal was hardly observed.

Δ: Separation of metal was slightly observed.

×: Significant separation of metal was observed.

5. Cutting Debris

The generation of cutting debris at the time of cutting the sample with a pair of scissors was visually observed.

◎: Cutting debris was hardly generated.

○: Cutting debris was slightly generated.

Δ: Cutting debris was moderately generated.

×: Cutting debris was significantly generated.

Example 1

Figure 4:
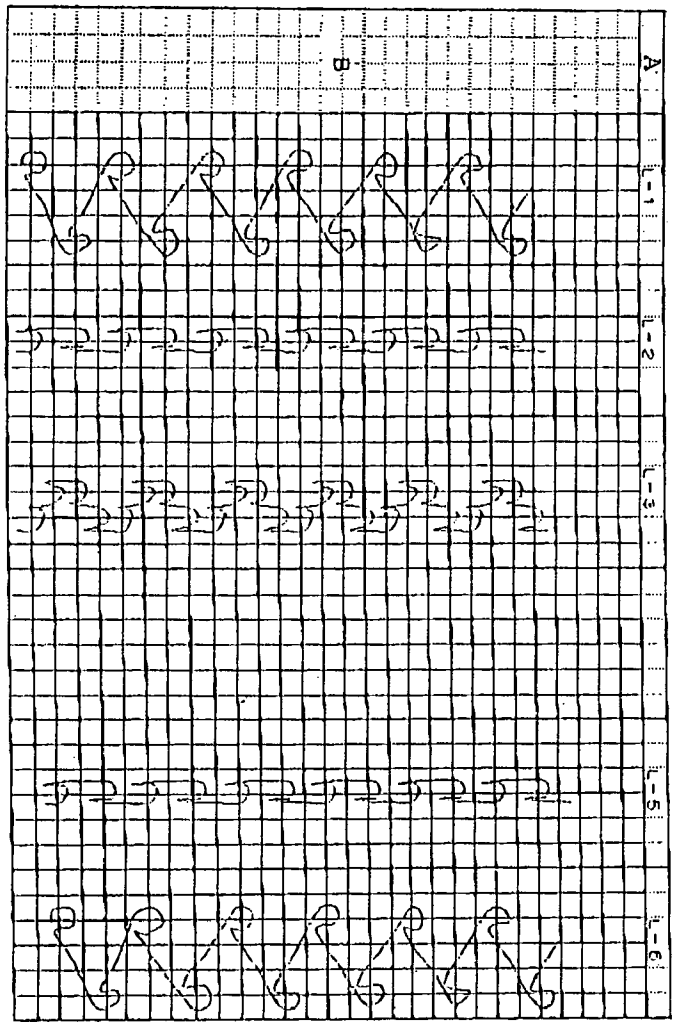
FIG. 4 is a structural view of the three dimensionally knitted base material of example 1.

A double raschel three dimensionally knitted structure was produced by using the structure pattern as shown in FIG. 4 and a double raschel knitting device having 22 gauge. Polyester fiber of 33 dtex/12f was used as the ground structure. Monofilament made of polyester fiber of 22 dtex was used as the connection thread. A blank product of 24 course/inch and 22 well/inch was obtained.

Next, the obtained blank product was scoured and dried, whereby excess oil contents and impurities were removed. Thereafter, the blank product was immersed, for two minutes, in an aqueous solution at the temperature of 40° C., which contained 0.3 g/L of palladium chloride, 30 g/L of tin (I) chloride, and 300 ml/L of 36% hydrochloric acid. The blank product was then washed with water. Thereafter, the blank product was immersed, for five minutes, in borofluoric acid whose acid concentration was 0.1 N at the temperature of 30° C. The blank product was then washed with water. Next, the blank product was immersed, for five minutes, in an electroless copper plating solution at the temperature of 30° C., which contained 7.5 g/L of copper sulfate, 30 ml/L of 37% formalin, and 85 g/L of Rochelle salt. The blank product was then washed with water. Thereafter, the blank product was immersed, for ten minutes and at the electric current density of 5A/dm$^2$, in an electrolytic nickel plating solution of pH 3.7 at the temperature of 35° C., which contained 300 g/L of nickel sulfamate, 30 g/L of boric acid, 15 g/L of nickel chloride, whereby nickel was plated on the product. The blank product was then washed with water. The obtained metal-coated, three dimensionally knitted structure was immersed in the acrylic resin emulsion ("Primal TR-934", manufactured by NIPPON ACRYL KAGAKUSHA) for 30 seconds, so that excess resin was removed. The product was then dried, whereby an electromagnetic wave shielding material whose conductive metal layer was coated with the acrylic resin was obtained. The obtained electromagnetic wave shielding material exhibited little variation in thickness thereof, performances which were as excellent as those of the gasket employing the conventional foam, and significantly reduced level of metal separation and cutting debris generation. The observed performances are summarized in Table 1.

Example 2

A double raschel three dimensionally knitted structure was produced by using the same structure pattern as example 1 and a double raschel knitting device having 22 gauge. Polyester fiber of 33 dtex/12f was used at L1 and L6 of the ground structure. Polyester-based heat-fusing composite thread of 33 dtex/12f (the ratio of the core thereof made of regular polyester with respect to the sheath thereof made of low-melting point polyester being 1:1) was used at L2 and L5 of the ground structure. Monofilament made of polyester fiber of 22 dtex was used as the connection thread. A blank product of 24 course/inch and 22 well/inch was thus obtained. The weight percentage of the heat-fusing thread used in the product was 65.4%.

Next, the obtained blank product was scoured and dried, whereby excess oil contents and impurities were removed. Thereafter, the blank product was immersed, for two minutes, in an aqueous solution at the temperature of 40° C., which contained 0.3 g/L of palladium chloride, 30 g/L of tin (I) chloride, and 300 ml/L of 36% hydrochloric acid. The blank product was then washed with water. Thereafter, the blank product was immersed, for five minutes, in borofluoric acid whose acid concentration was 0.1 N at the temperature of 30° C. The blank product was then washed with water. Next, the blank product was immersed, for five minutes, in an electroless copper plating solution at the temperature of 30° C., which contained 7.5 g/L of copper sulfate, 30 ml/L of 37% formalin, and 85 g/L of Rochelle salt. The blank product was then washed with water. Thereafter, the blank product was immersed, for ten minutes and at the electric current density of 5A/dm$^2$, in an electrolytic nickel plating solution of pH 3.7 at the temperature of 35° C., which contained 300 g/L of nickel sulfamate, 30 g/L of boric acid, 15 g/L of nickel chloride, whereby nickel was plated on the product. The blank product was then washed with water. An electromagnetic wave shielding material was obtained. The observed performances are summarized in Table 1.

Example 3

Figure 5:
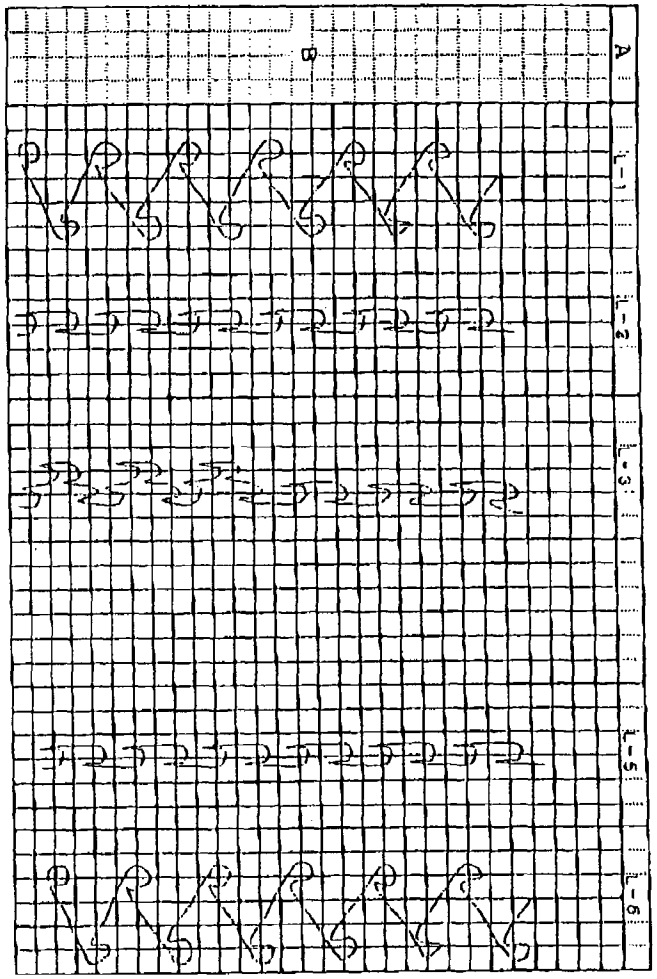
FIG. 5 is a structural view of the three dimensionally knitted base material of example 3.

A double raschel three dimensionally knitted structure was produced by using the pattern structure as shown in FIG. 5 and a double raschel knitting device having 22 gauge. Polyester fiber of 33 dtex/12f was used at L1 and L6 of the ground structure. Polyester-based heat-fusing composite thread of 33 dtex/12f (the ratio of the core thereof made of regular polyester with respect to the sheath thereof made of low-melting point polyester being 1:1) was used at L2 and L5 of the ground structure. Monofilament made of polyester fiber of 22 dtex was used as the connection thread. A blank product of 24 course/inch and 22 well/inch was thus obtained. The percentage of the heat-fusing thread used in the product was 65.4%.

Next, the product was processed in a manner similar to that of example 2, whereby an electromagnetic wave shielding material was obtained. Cutting of the electromagnetic wave shielding material was carried out at the portion not having the connection thread. The observed performances are summarized in Table 1.

Comparative Example 1

An elastic foam block made of polyether-based polyurethane having cell density of being 45 cell/inch was sliced by 2 mm by a slicer. A piece of Spanbond unwoven cloth made of polyester long fiber (single thread fiber degree of 2.2 dtex) was heat-fused to one side of the slice, and a piece of polyester fiber Tenjiku-ami knitting structure (56 dtex/24f, 65 course/45 well, thread density being 54 g/m$^2$, thickness being 0.47 mm) was heat-fused to the other side of the slice, whereby a composite sheet of the three-layered structure having 1.4 mm thickness was obtained. The obtained composite sheet was processed in a manner similar to that of example 2, whereby an electromagnetic wave shielding material was obtained. The observed performances are summarized in Table 1.

Comparative Example 2

Lipstop woven fabric (thread density thereof being 120 longitudinal thread/inch and 130 transverse thread/inch) made of nylon long fiber (44 dtex/10f) was processed in a manner similar to that of example 2, whereby a conductive woven fabric was obtained. The obtained conductive woven fabric was wound around polyether-based polyurethane (the cell density thereof being 45 cell/inch) with the ester-based hotmelt provided therebetween, whereby an electromagnetic wave shielding material was obtained. The observed performances are summarized in Table 1.

TABLE 1

| | Thickness (mm) | 50% Compression Stress | Shielding property (dB 1GHz) | Metal Separation | Cutting debris |
|---|---|---|---|---|---|
| Example 1 | 2.25 | 11.8 | 85.0 | ○ | ○ |
| Example 2 | 2.20 | 10.8 | 109.1 | ○ | ○ |
| Example 3 | 2.20 | 10.7 | 109.0 | ○ | ◎ |
| Comparative Example 1 | 1.40 | 19.1 | 90.0 | Δ | X |
| Comparative Example 2 | 2.00 | 27.5 | 82.8 | Δ | Δ |

The present invention provides an electromagnetic wave shielding material, which can be produced by a relative small number of production steps, suppresses separation of coating metal and reduces the amount of cutting debris generated at the time of cutting.

What is claimed is:

1. An electromagnetic wave shielding material consisting essentially of:

a fibrous structure base material and a conductive metal layer, wherein the fibrous structure base material is a three dimensionally knitted base material having a heat-fusing thread in at least a portion of the three dimensionally knitted base material, said heat-fusing thread is fuse-bonded at at least one contacting point, the three dimensionally knitted base material further comprising an upper ground structure (1), a lower ground structure (1) and connecting thread (2) interconnecting the upper ground structure (1) and the lower ground structure (1), the conductive metal layer is constituted by subjecting the three dimensionally knitted base material to an electroless plating with at least one conductive metal, and the connecting thread (2) of the three dimensionally knitted base material comprising portions (3) that extend in a sectional direction of the three dimensionally knitted base material, between the upper and lower ground structures (1,1), the portions (3) extending between the upper and lower ground structures (1,1) are entirely void of connecting thread (2) from both ground structures (1,1) and are situated between segments of the wave shielding material containing the connecting thread (2) extending between and interconnecting both the upper and lower ground structures (1,1), whereby minimizing debris upon cutting the electromagnetic wave shield material in the portions (3).

2. The electromagnetic wave shielding material of claim 1, characterized in that a heat-fusing thread is used by the amount of 30 to 90 mass % of the thread as one constituent of the three dimensionally knitted base material.

3. The electromagnetic wave shielding material of claim 1, characterized in that the heat-fusing thread is a composite thread having a core-sheath structure in which the core of the thread is made of polyester of one type and the sheath portion of the thread is made of polyester of another type whose melting point is lower than that of the polyester of the one type, and the weight ratio of the core with respect to the sheath is in the range of 1:2 to 9:1.

4. The electromagnetic wave shielding material of claim 1, characterized in that the three dimensionally knitted base material has a double raschel structure.

5. The electromagnetic wave shielding material of claim 1, wherein a conductive metal layer of the electromagnetic wave shielding material is coated with a synthetic resin.

6. The electromagnetic wave shielding material of claim 1, wherein the melting point of the heat-fusing thread is in the range of 100 to 190° C.

7. The electromagnetic wave shielding material of claim 2, wherein the melting point of the heat-fusing thread is in the range of 100 to 190° C.

8. The electromagnetic wave shielding material of claim 1, comprising portions having the connecting thread and portions omitting the connecting thread in wale and/or course directions of the knitted base material.

9. The electromagnetic wave shielding material of claim 1, having the structure of one of a normally intersecting connecting thread which normally intersects and interconnects the upper and lower ground structures, a diagonally intersecting connecting thread which diagonally intersects and interconnects the upper and lower ground structures, and a truss structure including both the normally and diagonally intersecting connecting threads in combined manner.

10. The electromagnetic wave shielding material of claim 1, wherein the upper ground structure is connected with the lower ground structure by alternatively arranging portions having the connecting thread and portions not having the connecting thread with a predetermined distance therebetween in wale and/or course directions of the knitted base material.

11. The electromagnetic wave shielding material of claim 10, wherein the portions not having the connecting thread are arranged in both the wale and course directions.

12. The electromagnetic wave shielding material of claim 10, wherein the portions not having the connecting thread are arranged in either the course or the wale directions.

13. The electromagnetic wave shielding material of claim 10, being structured and arranged to form gaskets by being cut at the portions not having the connecting thread.

14. An electromagnetic wave shielding material consisting essentially of a fibrous structure base material and a conductive metal layer, wherein the fibrous structure base material is a three dimensionally knitted base material composed of an upper ground structure (1), a lower ground structure (1) and connecting thread (2) interconnecting the upper ground structure (1) and the lower ground structure (1), the conductive metal layer is constituted by subjecting the three dimensionally knitted base material to an electroless plating with at least one conductive metal, and the connecting thread (2) of the three dimensionally knitted base material comprising portions (3) that extend, in a sectional direction of the three dimensionally knitted base material between the upper and lower ground structures (1,1), the portions (3) extending between the upper and lower ground structures (1,1) are entirely void of connecting thread (2) from both ground structures (1,1) an are situated between segments of the wave shielding material containing the connecting thread (2) extending between and interconnecting both the upper and lower ground structures (1,1), whereby minimizing debris upon cutting the electromagnetic wave shield material in the portions (3).

15. The electromagnetic wave shielding material of claim 1, withstanding a pressure at about 50% compression of at least about 10 as measured by the device TYPE PF-11 manufactured by Rafurokku Co. and possessing an electromagnetic damping rate of at least about 85 dB 1 GHz as measured according to the KEC method.

16. The electromagnetic wave shielding material of claim 1, characterized in that the heat-fusing thread is positioned at the portions which constitute the upper ground structure and the lower ground structure.

17. The electromagnetic wave shielding material of claim 1, characterized in that the connecting thread is monofilament.

18. The electromagnetic wave shielding material of claim 17 wherein the monofilament is polyester monofilament.

19. An electromagnetic wave shielding material comprising:

a fibrous structure base material and a conductive metal layer, wherein the fibrous structure base material is a three dimensionally knitted base material having a heat-fusing thread in at least a portion of the three dimensionally knitted base material and is free of foam, said heat-fusing thread is fuse-bonded at at least one contacting point, the three dimensionally knitted base material further comprising an upper ground structure (1), a lower ground structure (1) and connecting thread (2) interconnecting the upper ground structure (1) and the lower ground structure (1), the conductive metal layer is constituted by subjecting the three dimensionally knitted base material to an electroless plating with at least one conductive metal, and the connecting thread (2) of the three dimensionally knitted base material comprising portions (3) that extend in a sectional direction of the three dimensionally knitted base material, between the upper and lower ground structures (1,1), the portions (3) extending between the upper and lower ground structures (1,1) entirely void of connecting thread (2) from both ground structures (1,1) and are situated between segments of the wave shielding material containing the connecting thread (2) extending between and interconnecting both the upper and lower ground structures (1,1), whereby minimizing debris upon cutting the electromagnetic wave shield material in the portions (3).

20. An electromagnetic wave shielding material containing a fibrous structure base material and a conductive metal layer, wherein the fibrous structure material is free of foam and is a three dimensionally knitted base material composed of an upper ground structure (1), a lower ground structure (1) and connecting thread (2) interconnecting the upper ground structure (1) and the lower ground structure (1), the conductive metal layer is constituted by subjecting the three dimensionally knitted base material to an electroless plating with at least one conductive metal, and the connecting thread (2) of the three dimensionally knitted base material comprising portions (3) that extend, in a sectional direction of the three dimensionally knitted base material between the upper and lower ground structures (1,1), the portions (3) extending between the upper and lower ground structures (1,1) are entirely void of connecting thread (2) from both ground structures (1,1) an are situated between segments of the wave shielding material containing the connecting thread (2) extending between and interconnecting both the upper and lower ground structures (1,1), whereby minimizing debris upon cutting the electromagnetic wave shield material in the portions (3).

21. An electromagnetic wave shielding material consisting of:

a fibrous structure base material and a conductive metal layer, wherein the fibrous structure base material is a three dimensionally knitted base material having a heat-fusing thread in at least a portion of the three dimensionally knitted base material, said heat-fusing thread is fuse-bonded at at least one contacting point, the three dimensionally knitted base material further comprising an upper ground structure (1), a lower ground structure (1) and connecting thread (2) interconnecting the upper ground structure (1) and the lower ground structure (1), the conductive metal layer is constituted by subjecting the three dimensionally knitted base material to an electroless plating with at least one conductive metal, and the connecting thread (2) of the three dimensionally knitted base material comprising portions (3) that extend in a sectional direction of the three dimensionally knitted base material, between the upper and lower ground structures (1,1), the portions (3) extending between the upper and lower ground structures (1,1) are entirely void of connecting thread (2) from both ground structures (1,1) and are situated between segments of the wave shielding material containing the connecting thread (2) extending between and interconnecting both the upper and lower ground structures (1,1), whereby minimizing debris upon cutting the electromagnetic wave shield material in the portions (3).

* * * * *